US010375478B2

(12) United States Patent
Konno et al.

(10) Patent No.: US 10,375,478 B2
(45) Date of Patent: Aug. 6, 2019

(54) LOUDSPEAKER DIAPHRAGM AND LOUDSPEAKER INCLUDING SAME

(71) Applicant: PANASONIC INTELLECTUAL PROPERTY MANAGEMENT CO., LTD., Osaka (JP)

(72) Inventors: Shuichi Konno, Osaka (JP); Ryo Kuribayashi, Osaka (JP); Kazutaka Kubo, Osaka (JP); Hiroyuki Amada, Osaka (JP); Yohei Jin, Mie (JP); Hiroyuki Morimoto, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/834,449

(22) Filed: Dec. 7, 2017

(65) Prior Publication Data

US 2018/0167734 A1 Jun. 14, 2018

(30) Foreign Application Priority Data

Dec. 13, 2016 (JP) ..... 2016-240806

(51) Int. Cl.
*H04R 7/18* (2006.01)
*H04R 7/12* (2006.01)
(Continued)

(52) U.S. Cl.
CPC ..... *H04R 7/127* (2013.01); *H04R 1/288* (2013.01); *H04R 7/12* (2013.01); *H04R 7/18* (2013.01);
(Continued)

(58) Field of Classification Search
CPC ... H04R 7/12; H04R 7/18; H04R 7/20; H04R 31/006; H04R 9/025; H04R 9/06; H04R 2231/003; H04R 2307/204; H04R 2400/11
(Continued)

(56) References Cited

U.S. PATENT DOCUMENTS 5,319,718 A * 6/1994 Yocum ..... B29C 44/04 381/398
5,937,075 A * 8/1999 Goller ..... H04R 7/02 181/171
(Continued)

FOREIGN PATENT DOCUMENTS

JP 11-205895 7/1999

*Primary Examiner* — Huyen D Le
(74) *Attorney, Agent, or Firm* — Greenblum & Bernstein, P.L.C.

(57) ABSTRACT

A loudspeaker diaphragm includes a cone having a curved surface from the outer to the inner periphery, and an annular edge of which inner peripheral part is bonded to the front side of the outer peripheral part of the cone. When seen from the front, the outer periphery of the cone is defined by smooth connection of three larger-diameter parts tangent to a first circle with a larger diameter, and three smaller-diameter parts each located between adjacent two of the three larger-diameter parts and tangent to a second circle with a smaller diameter. In the cone, a shape defined by connecting together points at the same position on the central axis is more circular as the points approach the inner periphery from the outer periphery. The inner periphery of the edge has a smaller radius than the second circle.

8 Claims, 8 Drawing Sheets

(51) Int. Cl.

| | |
|---|---|
| ***H04R 1/28*** | (2006.01) |
| ***H04R 9/02*** | (2006.01) |
| ***H04R 7/20*** | (2006.01) |
| *H04R 9/06* | (2006.01) |

(52) U.S. Cl.
CPC ..... *H04R 7/20* (2013.01); *H04R 9/025* (2013.01); *H04R 9/06* (2013.01); *H04R 2307/021* (2013.01); *H04R 2307/204* (2013.01); *H04R 2400/11* (2013.01)

(58) Field of Classification Search
USPC ..... 381/396, 398, 403, 423, 424, 432; 181/171, 172; 29/594, 609.1
See application file for complete search history.

(56) References Cited

U.S. PATENT DOCUMENTS 6,224,801 B1 * 5/2001 Mango, III ..... B29C 45/14336 264/154
6,724,910 B1 * 4/2004 Heed ..... H04R 7/12 381/423

* cited by examiner

LOUDSPEAKER DIAPHRAGM AND LOUDSPEAKER INCLUDING SAME

BACKGROUND

1. Technical Field

The present disclosure relates to a loudspeaker diaphragm for various audio devices.

2. Description of the Related Art

FIG. 9 is a sectional view of a conventional loudspeaker. This loudspeaker includes bottom plate 51 with a pole piece, top plate 52, magnet 53, frame 55, diaphragm 56, voice coil body 59, damper 60, and dust cap 61.

Magnet 53 is placed between bottom plate 51 and top plate 52. Between the outer periphery of the pole piece of bottom plate 51 and the inner periphery of top plate 52, there is provided uniform magnetic gap 54. The upper surface of top plate 52 is coupled to the bottom of frame 55. Diaphragm 56 includes cone 57 and annular edge 58. The outer peripheral part of cone 57 is bonded to the reverse side of the inner peripheral part of edge 58. The bobbin of voice coil body 59 is coupled to the center of cone 57. The outer periphery of diaphragm 56 is coupled to the upper end of frame 55 via edge 58. Damper 60 is coupled to the bobbin of voice coil body 59 and frame 55. Dust cap 61, which protects magnetic gap 54 from dust, is placed near the center of cone 57.

Upon receiving an electrical signal, voice coil body 59 moves vertically with the force of magnetic gap 54. Along with this movement, cone 57 coupled to voice coil body 59 moves and emits sound from the front of the loudspeaker.

As in general loudspeakers, cone 57 has a perfectly-circular outer periphery and is tapered from the periphery toward the center such that the periphery and the center are concentric. Cone 57 has a uniform thickness from the outer periphery to the center. Edge 58 also has a uniform thickness from the outer periphery to the center.

FIG. 10 is a sectional view of another conventional loudspeaker. This loudspeaker is different from the loudspeaker shown in FIG. 9 only in that the outer peripheral part of cone 57 is bonded to the front side of the inner peripheral part of edge 58.

Japanese Unexamined Patent Application Publication No. H11-205895 (hereinafter, Patent Literature 1) discloses a loudspeaker diaphragm in which the outer periphery of cone 57 is in the form of a pentagon with rounded corners.

SUMMARY

The present disclosure provides a loudspeaker diaphragm including a cone and an edge easily pasted together and having a flat frequency response, and also provides a loudspeaker that includes the loudspeaker diaphragm, thereby having high sound quality.

The loudspeaker diaphragm according to the present disclosure includes a cone and an annular edge. The cone has a first outer periphery, an outer peripheral part along the first outer periphery, and a first inner periphery having a circular shape. The cone has a surface curved from the first outer periphery to the first inner periphery. The edge has a second outer periphery, a second inner periphery, and an inner peripheral part along the second inner periphery. When seen from the central axis of the first inner periphery, the first outer periphery is defined by smooth connection of three larger-diameter parts and three smaller-diameter parts. The three larger-diameter parts are tangent to a first circle having a first radius. The three smaller-diameter parts are each located between adjacent two of the three larger-diameter parts, and are tangent to a second circle having a second radius smaller than the first radius. In the cone, a shape defined by connecting together points of the same position on the central axis of the first inner periphery is more circular as the points approach the first inner periphery from the first outer periphery. The cone has a first side and a second side as a reverse side of the first side. The first inner periphery projects from the first outer periphery in the second side. The second inner periphery has a radius smaller than the second radius. The inner peripheral part of the edge is bonded to the first side at the outer peripheral part of the cone.

In this configuration, the cone having the above-described deformed shape allows the flattening of the frequency response in the middle- and high-frequency ranges. Furthermore, the inner peripheral part of the edge is bonded to the front side of the cone, and the inner periphery of the edge is perfectly circular, so that when seeing the loudspeaker with this diaphragm from the front, the user is unlikely to notice that the outer periphery of the cone is not perfectly circular. Thus, an appearance of the loudspeaker is maintained good.

DETAILED DESCRIPTION OF PREFERRED EMBODIMENTS

Prior to describing an exemplary embodiment of the present disclosure, problems with conventional loudspeakers will now be described in brief.

Figure 9:
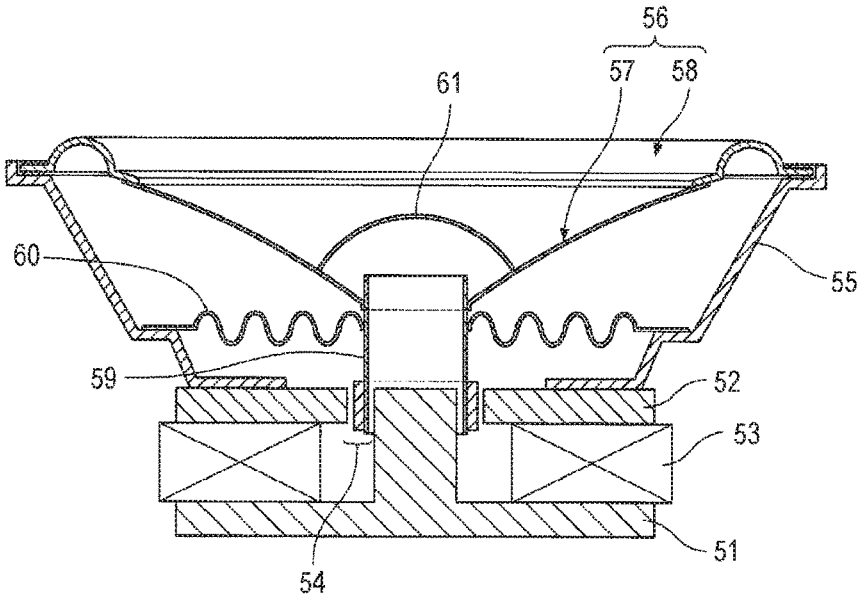
FIG. 9 PRIOR ART
FIG. 9 is a sectional view of a conventional loudspeaker.
Figure 10:
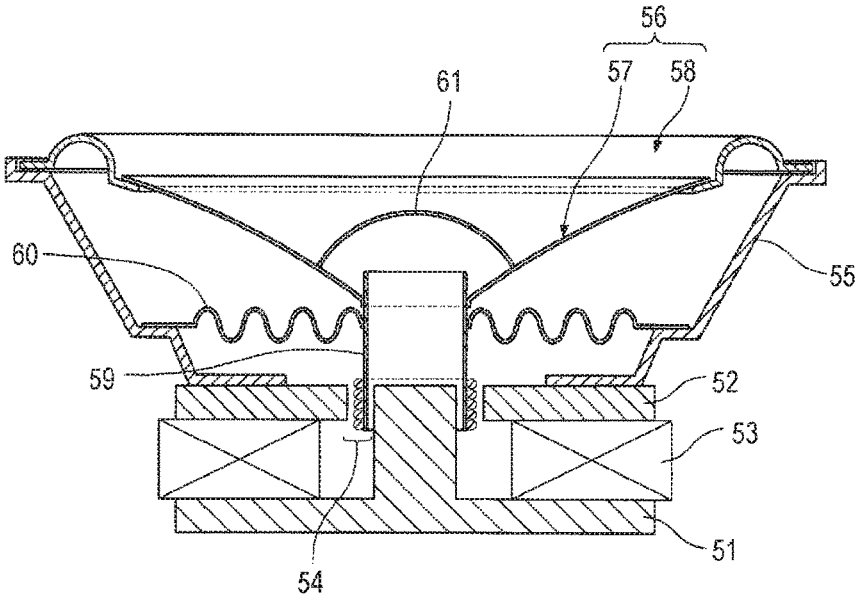
FIG. 10 PRIOR ART
FIG. 10 is a sectional view of another conventional loudspeaker.

As described above, in diaphragm 56 shown in FIGS. 9 and 10, cone 57 has a perfectly-circular outer periphery and is tapered toward the center such that the periphery and the center are concentric. Cone 57 of this shape may cause concentric resonances or may make edge 58 develop resonances. These resonances cause the frequency response to have peaks and dips.

The loudspeaker of Patent Literature 1 has a sound quality improved by dispersing resonances. This loudspeaker, however, requires a complicated process of pasting together the outer periphery of the cone and the inner periphery of the edge because these peripheries are pentagons with rounded corners.

Hereinafter, a loudspeaker diaphragm according to the exemplary embodiment of the present disclosure and a loudspeaker including the diagram will be described with reference to FIGS. 1 to 8.

Figure 1:
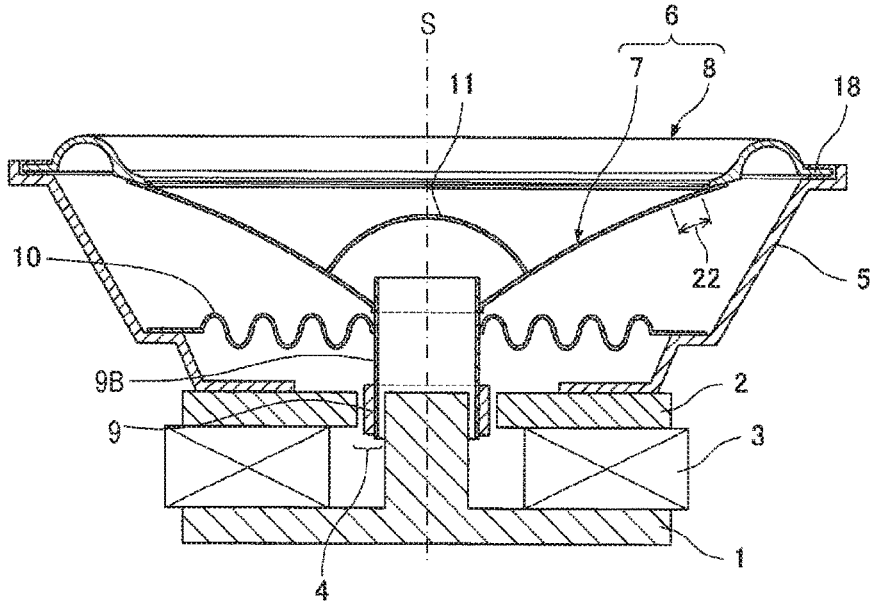
FIG. 1 is a sectional view of a loudspeaker including a loudspeaker diaphragm according to an exemplary embodiment of the present disclosure.

FIG. 1 is a sectional view of a loudspeaker including loudspeaker diaphragm 6 according to the exemplary embodiment of the present disclosure. This loudspeaker is, for example, a full-range loudspeaker.

The loudspeaker includes bottom plate 1 with a pole piece, top plate 2, magnet 3, frame 5, diaphragm 6, voice coil 9, damper 10, and dust cap 11. Magnet 3 is placed between bottom plate 1 and top plate 2. Between the outer periphery of the pole piece of bottom plate 1 and the inner periphery of top plate 2, there is provided uniform magnetic gap 4. Thus, bottom plate 1, top plate 2, and magnet 3 together form a magnetic circuit.

The upper surface of top plate 2 is coupled to the bottom of frame 5. Diaphragm 6 includes cone 7 and annular edge 8. Voice coil 9 is wound around bobbin 9B, which is coupled to the center of cone 7. In other words, bobbin 9B is coupled to a part along the inner periphery of cone 7. Voice coil 9 is disposed in magnetic gap 4.

The outer periphery of diaphragm 6 is coupled to the upper end of frame 5 at edge 8. In other words, frame 5 has an outer peripheral part coupled to a part along the outer periphery of edge 8.

Damper 10 is coupled to bobbin 9B and frame 5. To be more specific, damper 10 is coupled to bobbin 9B at a position different from the position where cone 7 is coupled to bobbin 9B. Damper 10 is further coupled to frame 5 at a different position from the outer peripheral part of frame 5. Dust cap 11, which protects magnetic gap 4 from dust, is placed near the center of cone 7.

Cone 7 is manufactured, for example, from paper made from wood pulp. In this case, edge 8 is made, for example, from ether-based foamed urethane having a larger elastic coefficient than cone 7.

Figure 2:
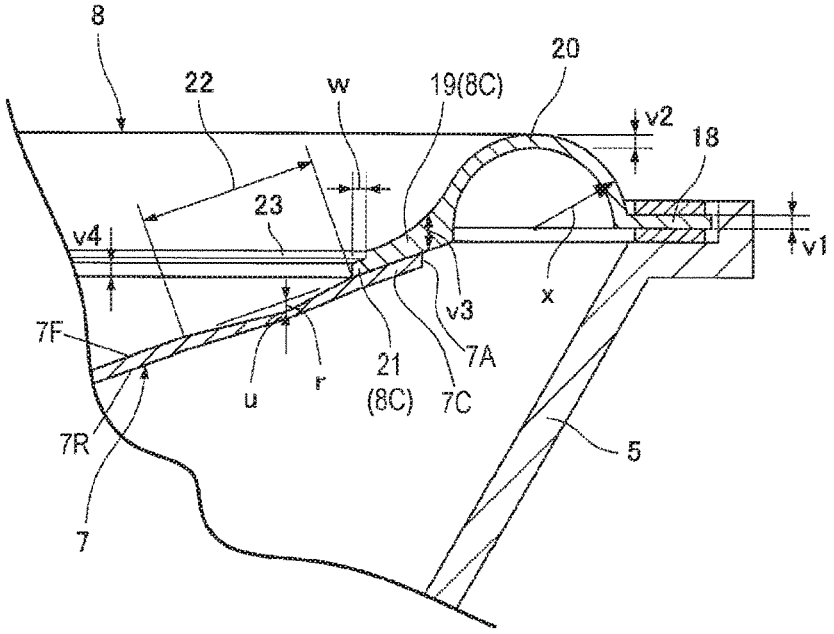
FIG. 2 is an enlarged sectional view of an outer peripheral region of a frame and an outer peripheral region of the loudspeaker diaphragm in the loudspeaker shown in FIG. 1.
Figure 3:
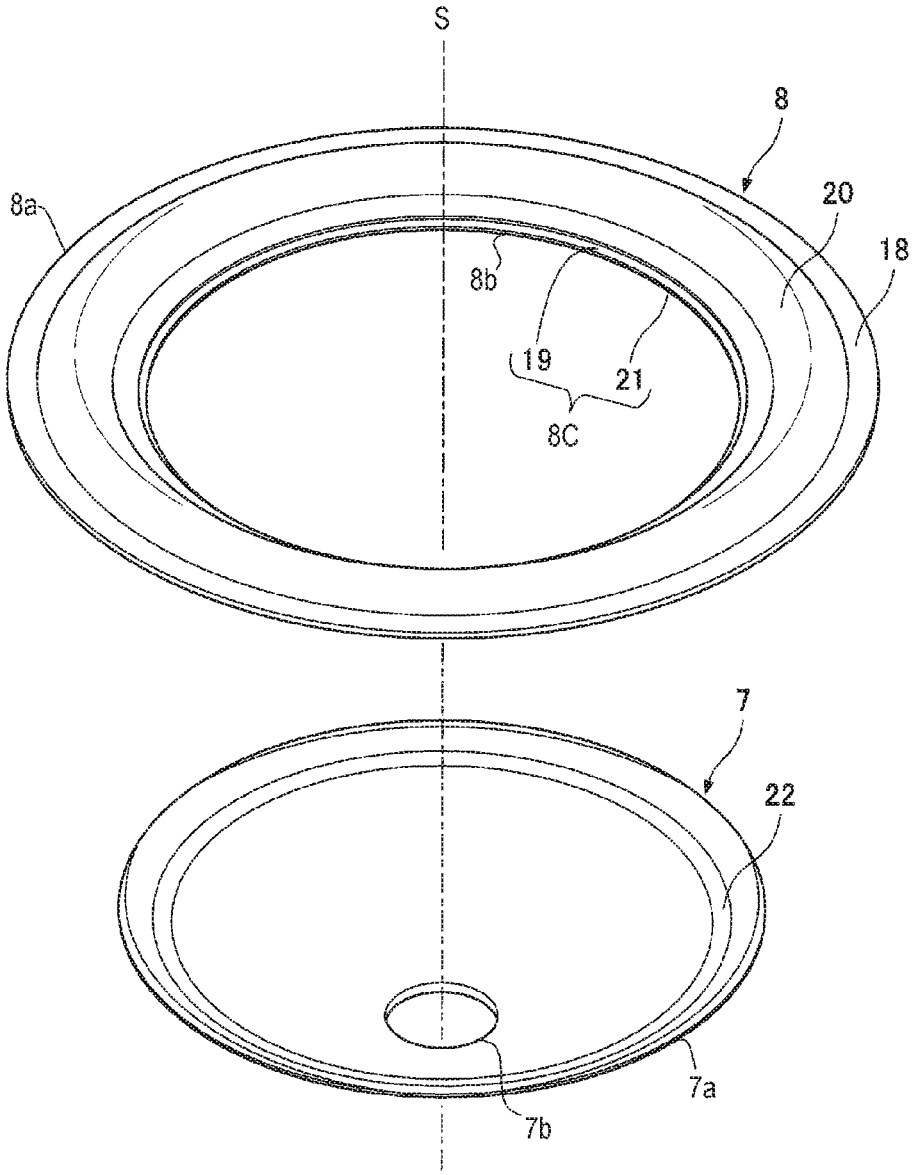
FIG. 3 is an exploded perspective view of the loudspeaker diaphragm shown in FIG. 1.
Figure 4:
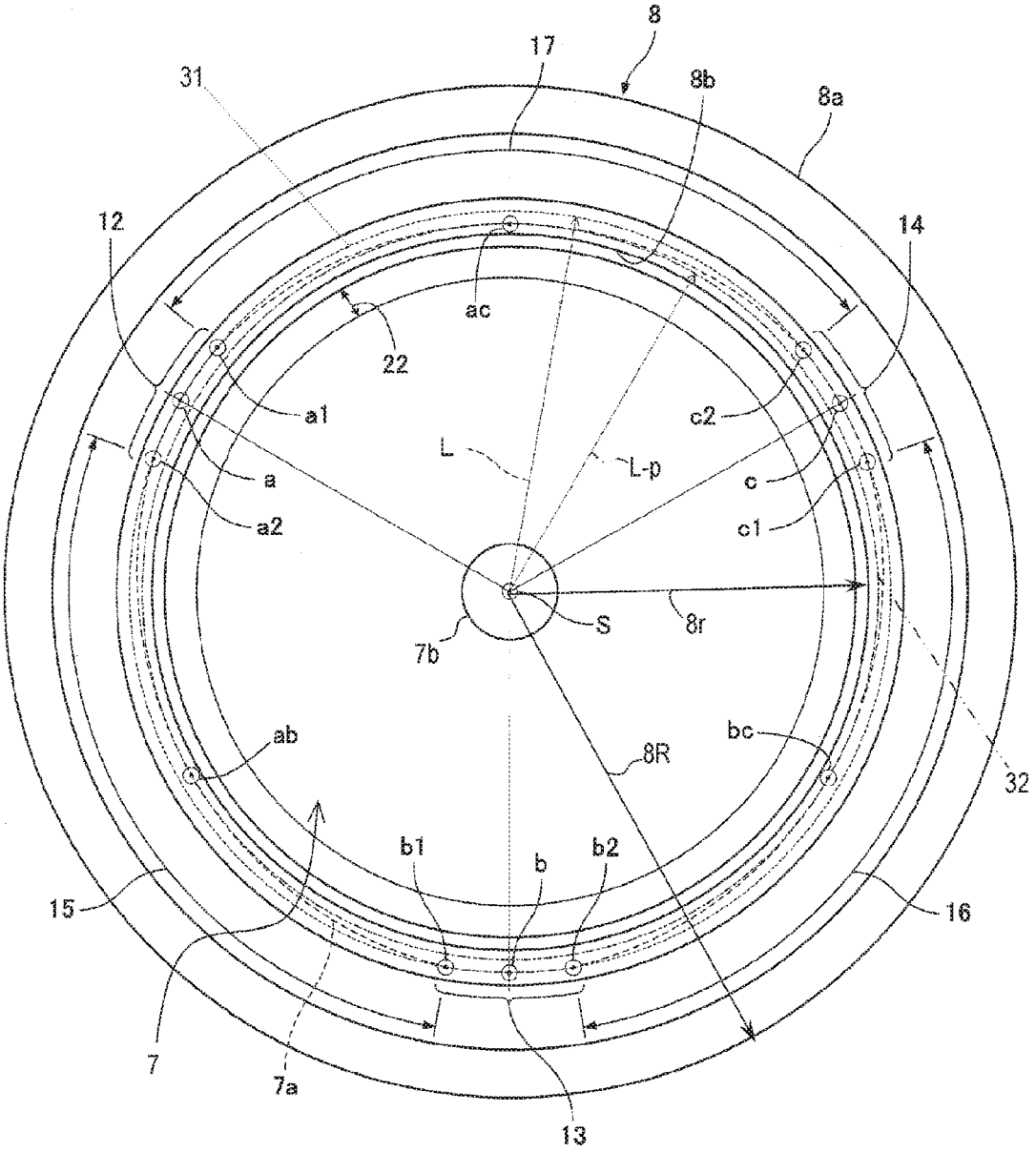
FIG. 4 is a front view of the loudspeaker diaphragm shown in FIG. 1.

FIG. 2 is an enlarged sectional view of the outer peripheral region of frame 5 and the outer peripheral region of diaphragm 6. FIG. 3 is an exploded perspective view of diaphragm 6, showing the process of pasting cone 7 and edge 8 together. FIG. 4 is a front view of diaphragm 6 seen from central axis S of inner periphery 7*b* of cone 7.

Cone 7 has outer periphery 7*a*, circular inner periphery 7*b*, and outer peripheral part 7C extending along outer periphery 7*a*. Cone 7 has a curved surface between outer periphery 7*a* and inner periphery 7*b* as shown in FIGS. 1 and 3. As shown in FIG. 2, cone 7 further has front side 7F as a first side, and reverse side 7R as a second side, which is the reverse side of the first side. As shown in FIG. 1, voice coil 9 is placed opposed to reverse side 7R of cone 7. As understood from FIGS. 1 to 3, inner periphery 7*b* projects from outer periphery 7*a* in reverse side 7R. Meanwhile, edge 8 has outer periphery 8*a*, inner periphery 8*b*, and inner peripheral part 8C extending along inner periphery 8*b*.

As shown in FIG. 2, inner peripheral part 8C of edge 8 is bonded to front side 7F at outer peripheral part 7C of cone 7.

Edge 8 is annular around central axis S, and both outer periphery 8*a* and inner periphery 8*b* are perfectly circular. Meanwhile, outer periphery 7*a* of cone 7 is not a perfect circle around central axis S.

Cone 7 has a curved surface and decreases in diameter toward inner periphery 7*b*, which is coupled to voice coil 9. To be more specific, cone 7 is in the shape in which outer periphery 7*a* has three larger-diameter sections 12, 13, and 14 equally distant (radius L) from central axis S, each adjacent two of sections 12, 13, and 14 are connected together via each one of smaller-diameter sections 15, 16, and 17 equally distant (a smaller radius than radius L) from central axis S. In cone 7, a shape defined by connecting together points at the same position on central axis S is more circular as the points approach inner periphery 7*b* from outer periphery 7*a*.

Figure 5:
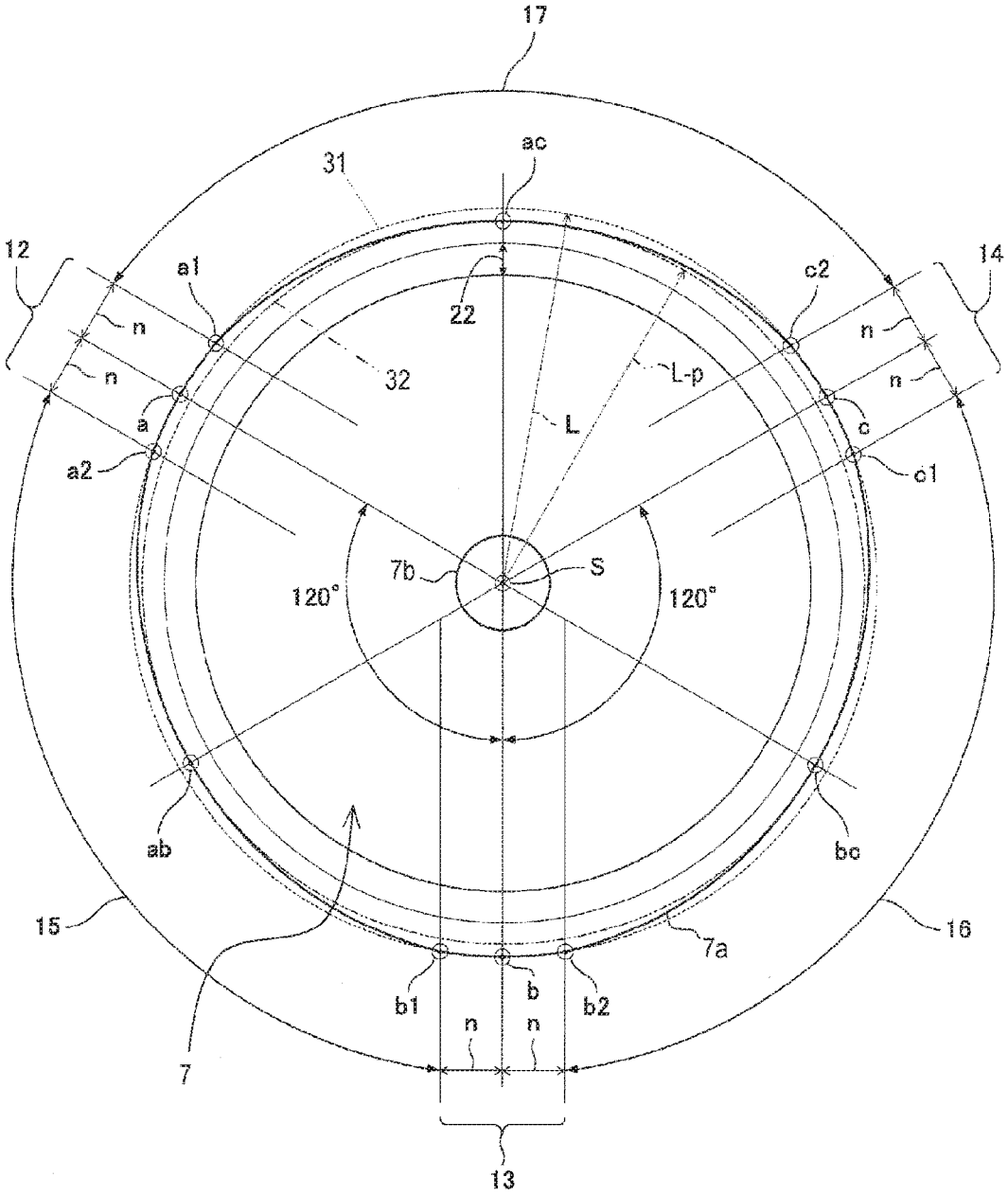
FIG. 5 is a front view of a cone of the loudspeaker diaphragm shown in FIG. 3.

FIG. 5 is a front view of cone 7.

Outer periphery 7*a* of cone 7 has points "a", "b", and "c", which are 120° apart from each other and are equally distant (radius L) from central axis S. The section from point "a1" to point "a2" with a distance 2n and with point "a" at the center is an are with radius L. Similarly, the section from point "b1" to point "b2" with "a" distance 2n and with point "b" at the center is an arc with radius L. Similarly, the section from point "c1" to point "c2" with a distance 2n and with point "c" at the center is an arc with radius L.

The section from point "a1" to point "c2" on outer periphery 7*a* of cone 7 is defined by smoothly connecting points "a1" and "c2" with the ends of an arc passing through point "ac", respectively. Point "ac" is equally distant from points "a1" and "c2" and is radius L-p distant from central axis S. The section from point "a2" to point "b1" and the section from point "b2" to point "c1" on outer periphery 7*a* of cone 7 are identical in shape to the section from point "a1" to point "c2". To be more specific, the section from point "a2" to point "b1" is defined by smoothly connecting points "a2" and "b1" with the ends of an arc passing through point "ab", respectively. Point "ab" is equally distant from points "a2" and "b1" and is radius L-p distant from central axis S. Similarly, the section from point "b2" to point "c1" is defined by smoothly connecting points "b2" and "c1" with the ends of an arc passing through point "bc", respectively. Point "bc" is equally distant from points b2 and c1 and is radius L-p distant from central axis S.

In other words, the section from point "a1" to point "a2", the section from point "b1" to point "b2", and the section from point "c1" to point "c2" on outer periphery 7*a* of cone 7 are larger-diameter sections 12, 13, and 14, respectively. Meanwhile, the section from point "a2" to point "b1", the section from point "b2" to point "c1", and the section from point "a1" to point "c2" on outer periphery 7*a* of cone 7 are smaller-diameter sections 15, 16, and 17, respectively.

When seen from another point of view, outer periphery 7*a* is defined by smoothly connecting points "a", "b", "c", "ab", "bc", and "ac" together. Points "a", "b", and "c" are three larger-diameter parts at which outer periphery 7*a* is tangent to first circle 31 with radius L. Meanwhile, points "ab", "bc", and "ac" are three smaller-diameter parts each which is located between adjacent two of the points "a", "b", and "c", and at which outer periphery 7*a* is tangent to second circle 32 with radius L-p smaller than radius L. Note that the interval between each adjacent two of the points a, b, and c is not limited to 120°.

As shown in FIG. 4, inner periphery 8*b* of edge 8 has a radius (i.e., inner diameter 8*r*) smaller than radius L-p. Outer periphery 8*a* has a radius (i.e., outer diameter 8R) larger than radius L.

The cross section of edge 8 and cone 7 will now be described in detail with reference to FIGS. 1 and 2.

Edge 8 has, on the outer peripheral part, outer peripheral fixed part 18 for fixing edge 8 to frame 5. Edge further has, on inner peripheral part 8C, inner peripheral fixed part 19 to be bonded to cone 7. Between these parts 18 and 19, there is provided round-shaped round-curved part 20. Outer peripheral fixed part 18 has thickness v1, which is equal to thickness v2 of round-curved part 20. Inner peripheral fixed part 19 has thickness v3, which is larger than thickness v1.

Edge 8 is formed by pressing a sheet-like material with a uniform thickness between upper and lower molds. As a result, outer peripheral fixed part 18 and round-curved part 20, which have the same thickness after being pressed, have the same material density. In contrast, after being pressed, inner peripheral fixed part 19 is thicker than round-curved part 20. Therefore, inner peripheral fixed part 19 is lower in density than outer peripheral fixed part 18 and round-curved part 20. Edge 8 also includes joint 21, which is further inside than inner peripheral fixed part 19. Join 21 has thickness v4 and length w, and is integrally formed with inner peripheral fixed part 19. Thickness v4 is smaller than thickness v3. Thus, after being pressed, joint 21 is thinner, and therefore, higher in density than inner peripheral fixed part 19. As described above, edge 8 includes round-curved part 20 between inner peripheral part 8C and outer periphery 8*a*. Inner peripheral part 8C includes joint 21 having inner periphery 8*b*, and inner peripheral fixed part 19, which is a second section between joint 21 and round-curved part 20. Inner peripheral fixed part 19 is thicker and lower in density than round-curved part 20. Joint 21 is higher in density than inner peripheral fixed part 19.

Part of inner peripheral fixed part 19 of edge 8 and joint 21 are bonded to outer peripheral part 7C of cone 7.

As shown in FIG. 2, cone 7 has first section 22, which is near outer periphery 7*a* and is also near inner periphery 8*b* of edge 8 bonded to cone 7. First section 22 is protruded toward reverse side 7R of cone 7 by distance r. First section 22 has thickness u, which is small in the middle and gradually increases toward both ends.

As described above, cone 7 has annular first section 22 along outer peripheral part 7C. First section 22 is thinner than the remaining portion of cone 7. Front side 7F may be smoothly depressed toward reverse side 7R in first section 22. Alternatively, reverse side 7R may be protruded from a portion adjoining first section 22.

Although not shown, reverse side 7R may alternatively be smoothly depressed toward front side 7F in first section 22. Further, front side 7F may alternatively be protruded from a portion adjoining the first section.

Next, a comparison in frequency response is made between the loudspeaker including diaphragm 6 according to the present exemplary embodiment and a typical loudspeaker in which the cone has a perfectly-circular outer periphery. These loudspeakers evaluated for frequency response have a diameter of 16 cm. Diaphragm 6 of the present exemplary embodiment has the following dimensions: radius L of 119/2 mm, n of 10 mm, radius L-p of 115/2 mm, thicknesses v1 and v2 of 1.0 mm, thickness v3 of 1.3 mm, thickness v4 of 1.0 mm, and length w of 1.0 mm. Round-curved part 20 has an R with radius x of 6.5 mm. Cone 7 has a thickness of 0.65 mm at the inner and outer peripheries, which are on both sides of first section 22. First section 22 has a width of 11.5 mm, distance r of 1.15 mm, and thickness u of 0.4 mm.

Figure 6:
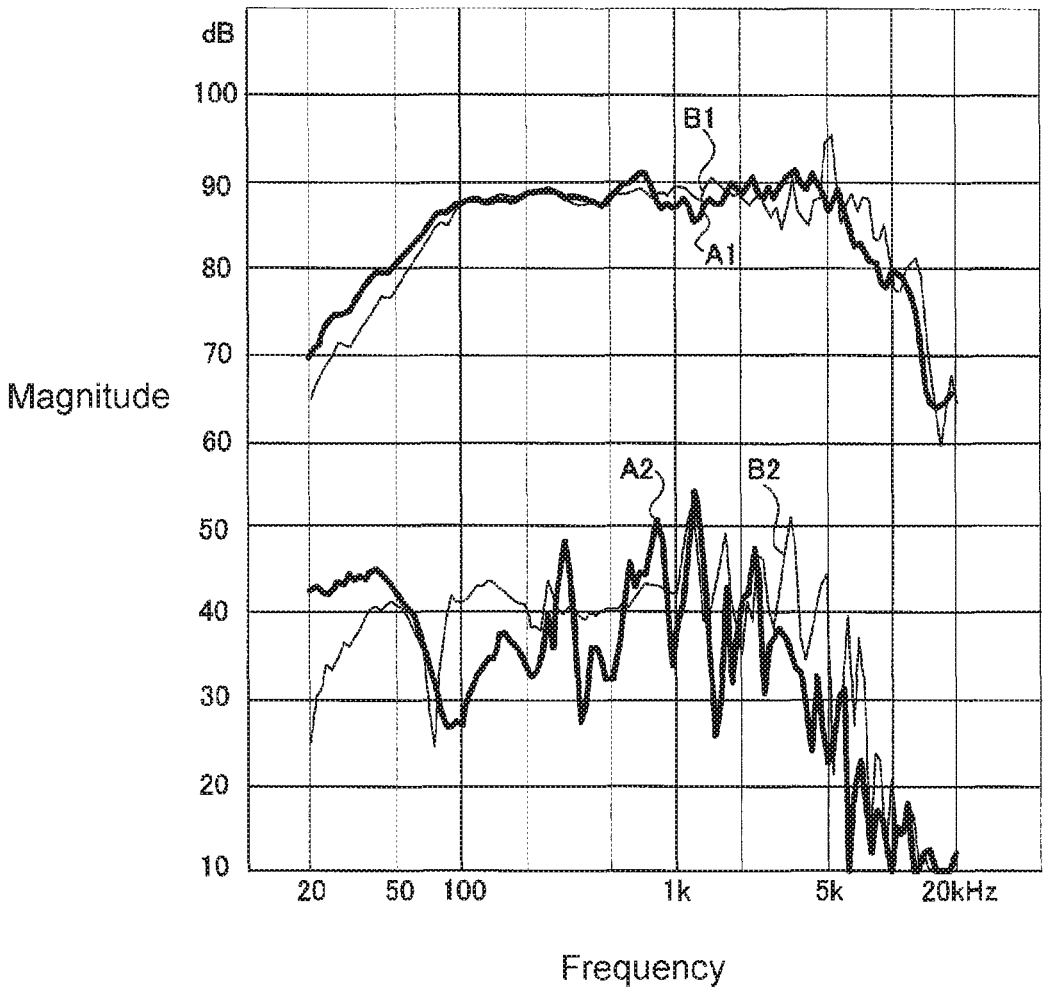
FIG. 6 is a diagram showing a frequency response of the loudspeaker shown in FIG. 1.

FIG. 6 shows a diagram of the frequency response of the loudspeaker according to the present exemplary embodiment (Example), and a typical loudspeaker in which the cone has a perfectly-circular outer periphery. In the diagram, line A1 represents the frequency response of the loudspeaker including diaphragm 6, whereas line B1 represents the frequency response of the typical loudspeaker. A comparison between the two frequency responses indicates that Example had no peaks or dips that appeared at and around 5 kHz in the typical loudspeaker.

As described above, outer periphery 7*a* of cone 7 is deformed from a perfect circle. However, when inner peripheral part 8C of edge 8 is bonded to front side 7F of cone 7, outer periphery 7*a* of cone 7 is covered with edge 8. Taking advantage of this feature, outer periphery 7*a* of cone 7 is made more perfectly circular than the cone shown in Patent Literature 1, and inner periphery 8*b* of edge 8 is made perfectly circular. In this case, when seen from the front of the loudspeaker, the user is unlikely to notice that outer periphery 7*a* of cone 7 is not perfectly circular. Hence, the loudspeaker has a good appearance. In addition, outer periphery 7*a* of cone 7 has a deformed shape defined by connecting larger-diameter sections 12, 13, and 14 together via each one of smaller-diameter sections 15, 16, and 17. As a result, the loudspeaker has a flat frequency response in the middle- and high-frequency ranges.

Furthermore, cone 7 includes first section 22, which functions to reduce the resonance propagating from the center of cone 7 toward edge 8. As a result, dips in the middle- and high-frequency ranges (at and around 5 kHz) are almost as low as in Patent Literature 1. In terms of reducing resonance propagation, it is preferable that in the cross section of first section 22, either front side 7F or reverse side 7R should be smoothly depressed from the center, which is the thinnest point. When first section 22 is press-formed, the side of first section 22 that is opposite to the depressed side may protrude in some cases. It would cause no problem to form first section 22 into this shape.

Furthermore, inner peripheral part 8C of edge 8 has inner peripheral fixed part 19. As described above, inner peripheral fixed part 19 is lower in density than outer peripheral fixed part 18 and round-curved part 20. This improves the resonance dispersion and makes the frequency response closer to be flat.

As another feature, edge 8 includes joint 21, which is further inside than inner peripheral fixed part 19. Joint 21 is higher in density than inner peripheral fixed part 19, and is integrally formed with inner peripheral fixed part 19. With this configuration, edge 8 can be easily pressed and pasted to cone 7 at joint 21. This ensures the bonding between cone 7 and edge 8 and facilitates the manufacture.

In FIG. 6, line A2 represents the frequency response of second harmonic distortion of Example. Line B2 represents the frequency response of second harmonic distortion of the loudspeaker including the typical diaphragm in which the cone has a perfectly-circular outer periphery. A comparison between line A2 and line B2 indicates that the distortion peaks in the middle- and high-frequency ranges are lower in Example.

This is because thickness v4 of joint 21 of edge 8 is smaller than thickness v3 of inner peripheral fixed part 19, and also because there is formed stepped portion 23 on the borderline between inner peripheral fixed part 19 and joint 21. This is the reason that the harmonic distortion peaks in the middle- and high-frequency ranges (at and around 5 kHz) are low as shown by line A2 of FIG. 6. The above-described shape of edge 8 also contributes to improving the moldability of edge 8.

Figure 7A:
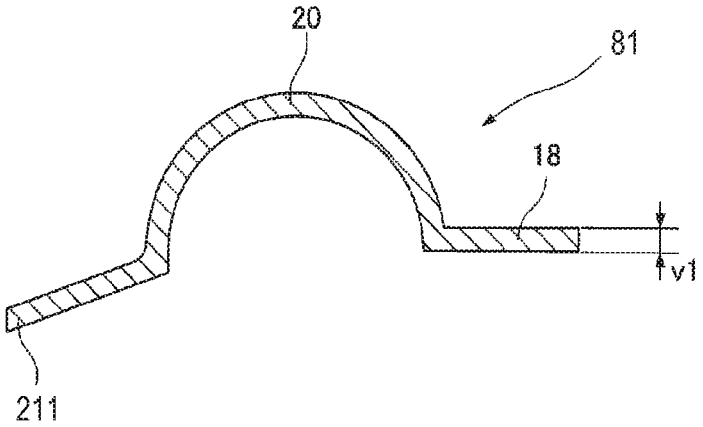
FIG. 7A is a sectional view of a type of edge of a loudspeaker diaphragm.
Figure 7B:
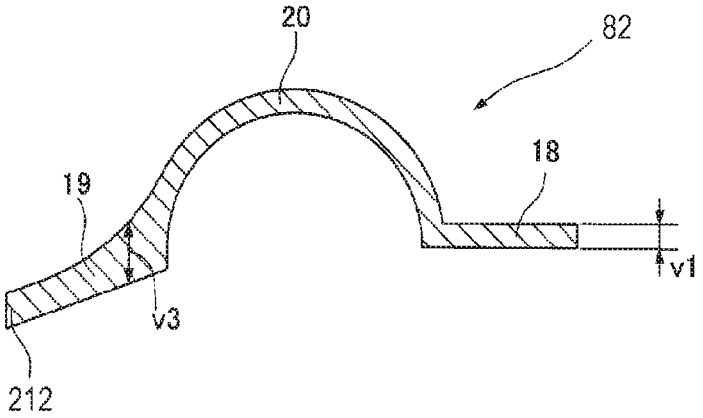
FIG. 7B is a sectional view of another type of edge of a loudspeaker diaphragm.
Figure 7C:
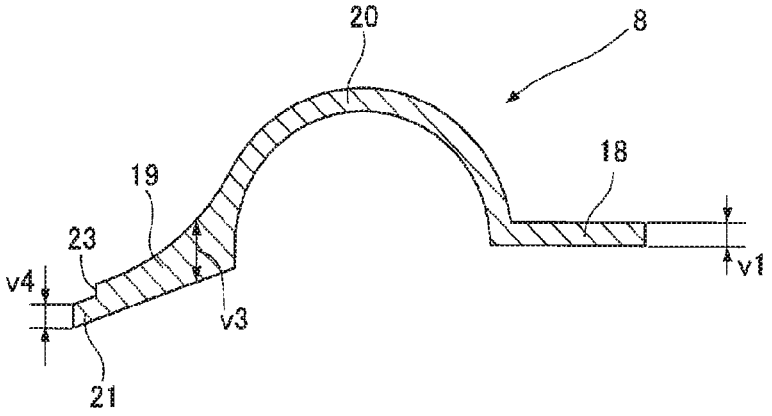
FIG. 7C is a sectional view of the edge of the loudspeaker diaphragm shown in FIG. 2.

The shape of edges will now be described in detail. FIGS. 7A to 7C are sectional views of different types of edges.

FIG. 7A shows edge 81, which has a uniform thickness and a high density from outer peripheral fixed part 18 to joint 211 via round-curved part 20.

FIG. 7B shows edge 82, and FIG. 7C shows edge 8. In these edges, thickness v3 of inner peripheral fixed part 19 is larger than thickness v1 of outer peripheral fixed part 18. Edge 8 has the configuration described above with reference to FIG. 2.

As described above, in edge 8, thickness v3 of part 19 is larger than thickness v1 of part 18, so as to provide a low-density region. This makes edge 8 have a higher internal loss, a higher flatness of frequency response, and a lower peak of distortion than edge 81.

As another feature of edge 8, joint 21 is thinner and has a higher density than inner peripheral fixed part 19, so that inner peripheral fixed part 19 as the low-density region are sandwiched between high-density regions at the inner and outer peripheries thereof. As a result, inner peripheral fixed part 19 with a high internal loss is held, so that edge 8 is highly moldable as a whole and maintains its shape. Thus, edge 8 has a high internal loss and high performance, and can be efficiently produced.

In contrast, although edge 82 shown in FIG. 7B includes a low-density region by making inner peripheral fixed part 19 have the same thickness v3 as in edge 8 of FIG. 7C, joint 212 is not a high-density region like joint 21 made thinner than inner peripheral fixed part 19 of edge 8. Therefore, it is difficult to form inner peripheral fixed part 19 with a low density uniformly. Another drawback is that inner peripheral fixed part 19 has low shape retention, so that even if the frequency response becomes flat, the flatness may not be kept. As a result, edge 8 has a preferred configuration.

Specific examples of joint 21 will now be described in detail. When a loudspeaker has a diameter of 16 cm, the speaker has the following dimensions: thicknesses v1 and v2 of 1.0 mm, thickness v3 of 1.3 mm, thickness v4 of 1.0 mm, length w of 1.0 mm, and radius x of 6.5 mm in R-shaped round-curved part 20. In this case, the structure with uneven thickness can be achieved by forming stepped portion 23 to make thicknesses v4 and v1 equal, and also by thinning joint 21, which is the innermost peripheral part, to increase the compressibility. As a result, inner peripheral fixed part 19 with the improved internal loss absorbs the resonance.

Finally, the exemplary embodiment is compared with Patent Literature 1.

In a loudspeaker diaphragm in which the outer periphery of the cone is in the shape of a pentagon with rounded corners as in Patent Literature 1, frequency response distortion in the middle frequency range (in and near the range of 1 to 2 kHz) is low. Meanwhile, diaphragm 6 according to the present exemplary embodiment is in the shape of a triangle with rounded corners. Since the rounded corners can be smaller in radius than in a pentagon, diaphragm 6 can cover a higher-frequency range as resonance frequencies to be affected. Thus, diaphragm 6 can disperse resonance not only in the middle-frequency range but also in the high-frequency range. Diaphragm 6 achieves smooth frequency response by providing first section 22, which is bendable on the periphery of cone 7, thereby controlling (reducing) the resonance in a higher frequency range (at and around 5 kHz).

Figure 8:
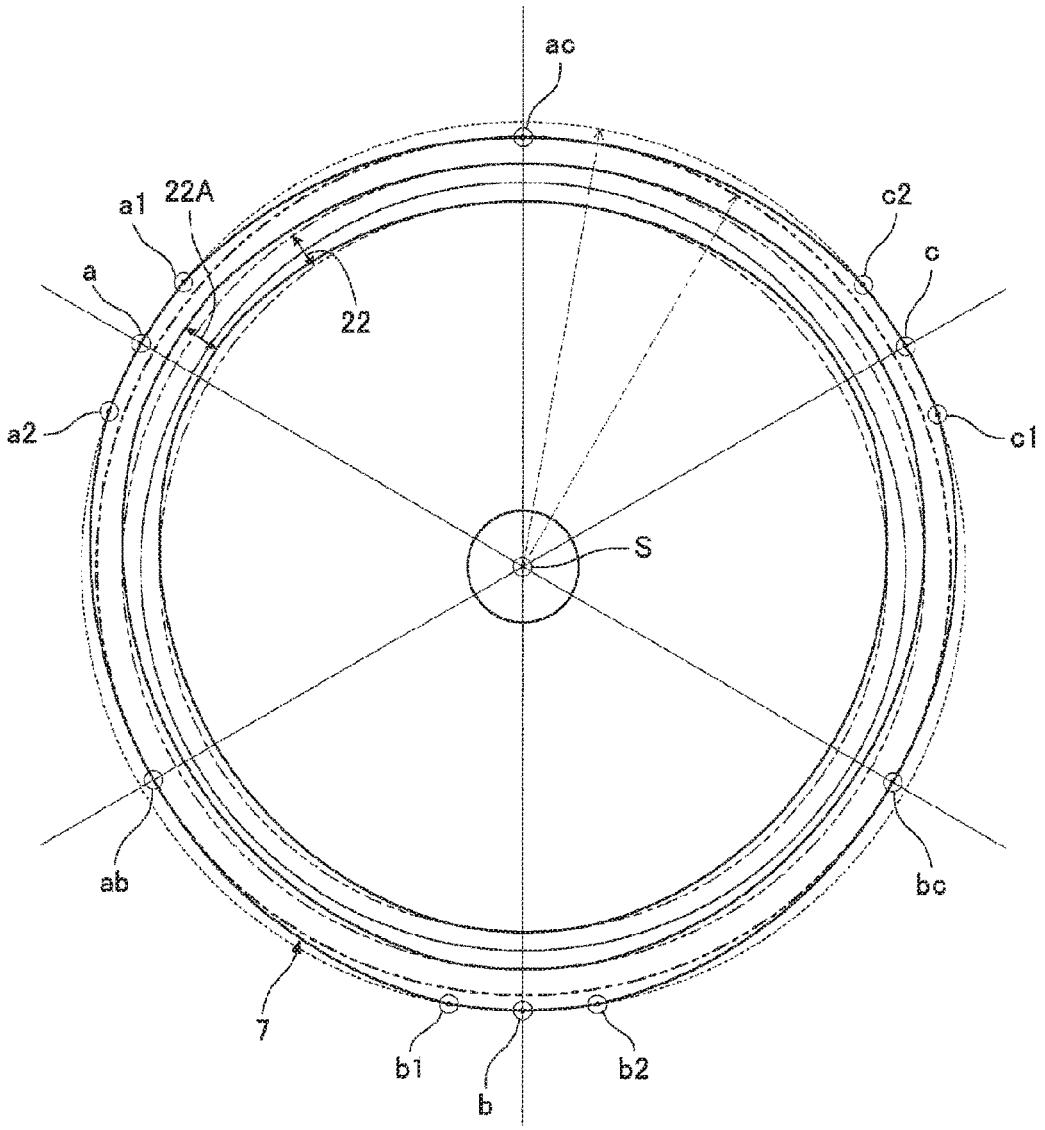
FIG. 8 is a front view of a cone of a different loudspeaker diaphragm according to the exemplary embodiment of the present disclosure.

In FIGS. 4 and 5, the outer periphery of first section 22 of cone 7 is perfectly circular in planar view, but is not limited to this shape. Alternatively, as shown in FIG. 8, the outer periphery of first section 22A may extend along the outer periphery of cone 7 in planar view. First section 22A with this shape allows the frequency response to be further flattened. Note that first section 22 with a perfectly-circular outer periphery is indicated by fictive lines.

As described above, the loudspeaker diaphragm according to the present disclosure can be used in loudspeakers for various audio devices so that the loudspeakers can have higher frequency response in the middle- and high-frequency ranges, and hence, better sound quality.

What is claimed is:

1. A loudspeaker diaphragm comprising:

a cone including:

a first outer periphery;

an outer peripheral part along the first outer periphery;

a first inner periphery having a circular shape; and an annular first section along the outer peripheral part, and the annular first section is thinner than a remaining portion of the cone other than the annular first section, and an annular edge including:

a second outer periphery;

a second inner periphery; and an inner peripheral part along the second inner periphery, wherein the cone has a surface curved from the first outer periphery to the first inner periphery, the first outer periphery is defined, when seen from a central axis of the first inner periphery, by smooth connection of three larger-diameter parts tangent to a first circle having a first radius, and three smaller-diameter parts each located between adjacent two of the three larger-diameter parts and tangent to a second circle having a second radius smaller than the first radius, in the cone, a shape defined by connecting together points at a same position on the central axis of the first inner periphery is more circular as the points approach the first inner periphery from the first outer periphery, the cone has a first side and a second side as a reverse side of the first side, the first inner periphery projects from the first outer periphery in the second side, a radius of the second inner periphery is smaller than the second radius, and the inner peripheral part of the annular edge is bonded to the first side of the cone at the outer peripheral part of the cone.

2. The loudspeaker diaphragm according to claim 1, wherein the first side is smoothly depressed toward the second side in the annular first section.

3. The loudspeaker diaphragm according to claim 2, wherein the second side is protruded from a portion adjoining the annular first section.

4. The loudspeaker diaphragm according to claim 1, wherein the second side is smoothly depressed toward the first side in the annular first section.

5. The loudspeaker diaphragm according to claim 4, wherein the first side is protruded from a portion adjoining the annular first section.

6. The loudspeaker diaphragm according to claim 1, wherein the annular first section has an outer periphery, either being in a shape of a circle or extending along the first outer periphery of the cone.

7. The loudspeaker diaphragm according to claim 1, wherein the annular edge further includes a round-curved part between the inner peripheral part and the second outer periphery, the inner peripheral part includes:

a joint defining the second inner periphery of the edge; and a second section between the joint and the round-curved part, the second section is thicker and lower in density than the round-curved part, and the joint has a higher density than the second section.

8. A loudspeaker comprising:

the loudspeaker diaphragm according to claim 1;

a frame having an outer peripheral part coupled to a part along the second outer periphery of the annular edge of the loudspeaker diaphragm;

a magnetic circuit provided with a magnetic gap;

a bobbin coupled to a part along the first inner periphery of the cone of the loudspeaker diaphragm;

a voice coil held in the bobbin and located in the magnetic gap; and a damper coupled to the bobbin at a position different from a position where the cone is coupled to the bobbin, the damper also being coupled to the frame at a different position from the outer peripheral part of the frame.

* * * * *